US005215152A

United States Patent [19]

Duckworth

[11] Patent Number: 5,215,152

[45] Date of Patent: Jun. 1, 1993

[54] ROTATING PULSE VALVE FOR DOWNHOLE FLUID TELEMETRY SYSTEMS

[75] Inventor: Allen Duckworth, Middlefield, Conn.

[73] Assignee: Teleco Oilfield Services Inc., Meriden, Conn.

[21] Appl. No.: 846,523

[22] Filed: Mar. 4, 1992

[51] Int. Cl.[5] ..... E21B 47/00; G01V 1/00

[52] U.S. Cl. ..... 175/48; 367/84

[58] Field of Search ..... 175/40, 48, 50; 367/81-85

[56] References Cited

U.S. PATENT DOCUMENTS

| | | | |
|---|---|---|---|
| Re. 30,055 | 7/1979 | Claycomb | 367/84 |
| 3,770,006 | 11/1973 | Sexton et al. . | |
| 3,958,217 | 5/1976 | Spinnler . | |
| 3,982,224 | 9/1976 | Patton . | |
| 3,997,867 | 12/1976 | Claycomb . | |
| 4,351,037 | 9/1982 | Scherbatskoy . | |
| 4,405,021 | 9/1983 | Mumby . | |
| 4,531,579 | 6/1985 | Larronde et al. . | |
| 4,550,392 | 10/1985 | Mumby . | |
| 4,630,244 | 12/1986 | Larrode | 367/84 |
| 4,655,289 | 4/1987 | Schoeffler . | |
| 4,675,852 | 6/1987 | Russell et al. | 367/84 |
| 4,785,300 | 11/1988 | Chin et al. | 367/84 |
| 4,825,421 | 4/1989 | Jeter . | |
| 4,914,637 | 4/1990 | Goodsman | 367/84 |
| 4,956,823 | 9/1990 | Russell et al. | 367/84 |

*Primary Examiner*—Thuy M. Bui
*Assistant Examiner*—Frank S. Tsay
*Attorney, Agent, or Firm*—Fishman, Dionne & Cantor

[57] ABSTRACT

A rotating pulse valve for use in a mud pulse telemetry system is presented. In accordance with the invention, a valve is diametrically mounted in a channel of a segment of a drill string wherein drilling fluids flows. The valve comprises blades which are configured so as to be impelled (i.e., rotated) by the flow of the drilling fluid. An escapement mechanism is employed to restrain the valve in selected positions thereby at least partially obstructing the flow of the drilling fluid which results in generating positive pressure pulses or waves in the drilling fluid in response to downhole conditions.

24 Claims, 2 Drawing Sheets

ROTATING PULSE VALVE FOR DOWNHOLE FLUID TELEMETRY SYSTEMS

BACKGROUND OF THE INVENTION

This invention relates to the field of mud pulse telemetry such as found in well logging, in particular when used with measurement while drilling (MWD) devices. More particularly, this invention relates to a new and improved valve scheme disposed in the path of mud flow in a drill string to provide pressure waves or pulses.

Mud pulse telemetry systems for communication from a downhole location in a drill string to the surface are well known in the art. These pulses comprise either a standing pressure wave which is generated by an oscillating valve or a series of pressure pulses which are also generated by a valve or other devices causing a partial obstruction in the flow of mud downhole. This obstruction (whether oscillating or a pulse mode) generates a positive pressure wave which permeates up the drilling mud in the drill string. This pressure wave is then detected at the surface. Examples of such positive pressure pulse telemetry systems include U.S. Pat. Nos. 4,655,289; 4,531,579; 3,958,217; 3,770,006; 3,982,224; and 3,997,876. In general, each of these patents disclose systems in which the flow of drilling fluid through the drill string is periodically restricted to send positive pressure pulses up the column of the drilling fluid to indicate a downhole condition.

Another method of mud pulse telemetry which is also well known involves venting a portion of the drilling fluid so as to change the resistance pressure and thereby send a negative pulsa wave up the drilling fluid to the surface. Examples of such negative pressure pulse telemetry systems include U.S. Pat. Nos. 4,405,021 and 4,351,037. These systems periodically vent drilling fluid from the drill string interior to an annular space between the drill string and the well bore to send negative pressure pulses to the surface in a coded sequence corresponding to a sensed downhole condition. It will be appreciated that the above references to such prior art patents being merely for purposes of illustration and not a complete listing of relevant patents in this field.

The positive pressure pulse telemetry systems generally require large amounts of power to partially restrict the flow of mud down the drill string in order to generate positive pressure pulses. These valves are controlled by large complex mechanical systems having a solenoid or some type of downhole motor. The negative pressure pulse telemetry systems require complex venting schemes and also require a significant amount of power to open or close the vent thereby overcoming the significant force of the flow of the drilling fluid. Thus, a need exists for a mud pulse telemetry system wherein the electrical and mechanical power required to generate the pulses are reduced.

SUMMARY OF THE INVENTION

The above-discussed and other drawbacks and deficiencies of the prior art are overcome or alleviated by the rotating pulse valve of the present invention. In accordance with the rotating pulse valve of the present invention, the valve comprises a rotor having blades contoured in such a manner that the flow of fluid over the blades creates a continuous unidirectional torque. The rotor is mounted on a shaft which passes through an opening in the drill string wherein the drilling fluid flows. The rotation of the shaft in unison with the rotor is controlled so that the valve can be maintained in an open or closed position, thereby generating a positive pressure pulse in the drilling fluid. A partially closed position replacing the closed position may be required when the flow rate of drilling fluid is large and positioning the valve in a fully closed position may cause an excessive pressure drop. The valve is configured such that even when in a fully closed position, it does not completely restrict flow of drilling fluid down the drill string. Valve stops at open and closed positions are controlled by an escapement mechanism such that each release of the escapement mechanism allows the valve to rotate (under the torque from the fluid flow) to the next stop, thus opening and closing alternately. The escapement mechanism may be controlled by a solenoid which is actuated by an electric current. Thus, the current through the solenoid may be supplied in an encoded sequence of pulses representing the information to be transmitted via mud pulse telemetry.

The present invention provides a simpler and more efficient means for generating positive pressure pulses in the drilling fluid of a drill string. Further, the electrical power required to control the escapement device is believed to be less than that required in the pulse telemetry systems of the prior art.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGS..

DESCRIPTION OF THE PREFERRED EMBODIMENT

Figure 3:
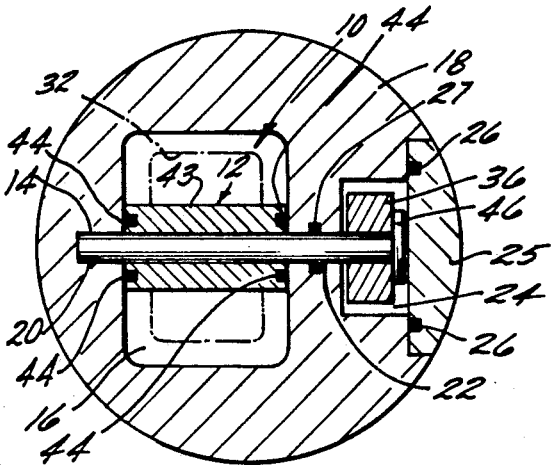
FIG. 3 is a cross-sectional top view of the telemetry scheme of FIG. 1 with the valve in the open position.
Figure 1:
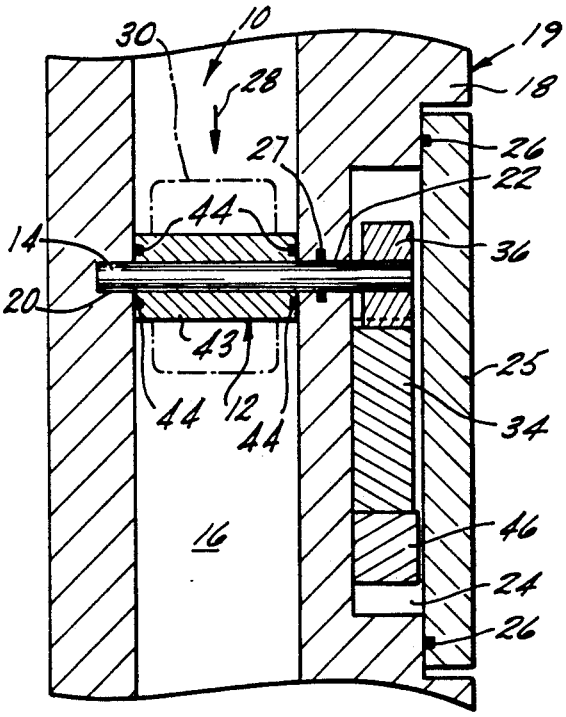
FIG. 1 is a cross-sectional side view of a rotating pulse valve telemetry scheme with the valve in a closed position in accordance with the present invention.
Figure 2:
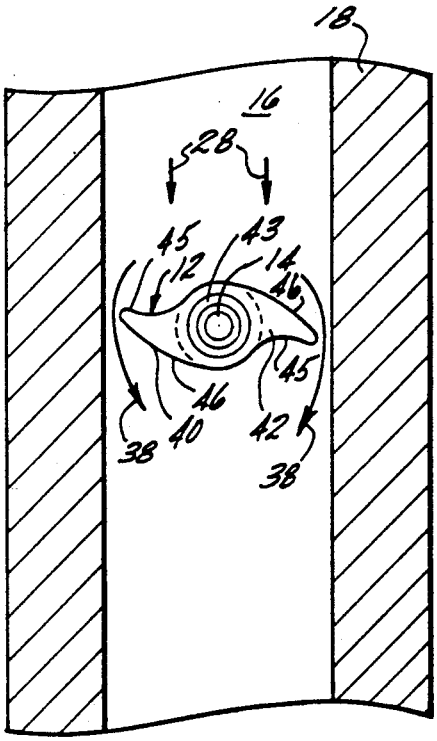
FIG. 2 is a side view partially sectioned of the telemetry scheme of FIG. 1 with the valve in the closed position.
Figure 4:
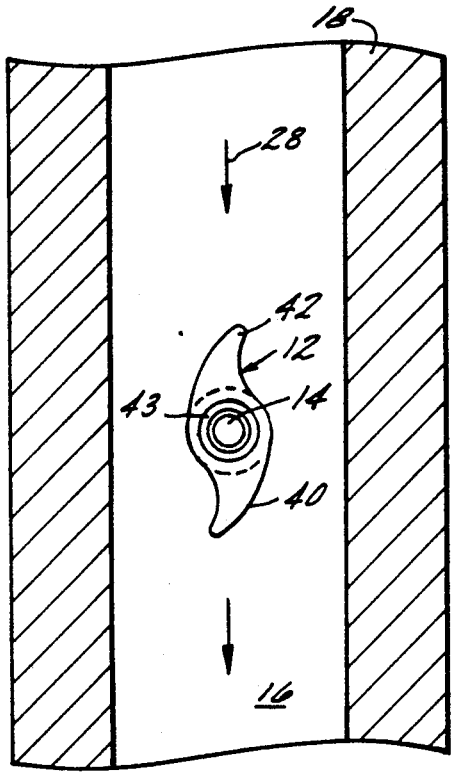
FIG. 4 is a side view partially sectioned of the telemetry scheme of FIG. 1 with the valve in the open position.

Referring to FIGS. 1 and 2, a preferred embodiment of a rotating pulse valve for inducing positive pressure pulses in drilling fluid is shown generally at 10. In accordance with the present invention, a valve 12 is disposed on a shaft 14 for rotation in unison therewith. Shaft 14 extends diametrically across a channel 16 in a section 18 of drill collar 19. Accordingly, valve 12 is diametrically mounted in channel 16. Shaft 14 is supported at one end in a recess 20 in the drill collar section 18. The other end of shaft 14 extends through an opening 22 into a hatch cavity 24. This hatch cavity 24 is preferably filled with oil or other lubricating fluid maintained at the same pressure as the drill pipe bore. Seals 26 and 27 prevent leakage of this fluid out, or borehole fluids in. A seal 27 is provided about shaft 14 within opening 22 to prevent drilling fluid flowing in channel 16 from entering hatch 24. A cover plate 25 includes a seal 26 for enclosing hatch 24 and preventing fluids in the bore hole from entering hatch 24. The direction of flow of drilling fluid (e.g. drilling mud) is indicated by an arrow 28. Valve 12 is shown in what is defined as its closed position. The closed position provides the maximum resistance to drilling fluid flow. Accordingly, valve 12 is perpendicular to the direction of drilling fluid flow when it is in the closed position. The closed position is best shown in FIG. 2. A broken line 30 indicates an open position for valve 12. The open position provides the least resistance to drilling fluid flow. Referring also to FIGS. 3 and 4, the rotating pulse valve 10 is shown in its open position. Accordingly, valve 12 is in alignment with the direction of drilling fluid flow when it is in the open position. The open position is best shown in FIG. 4. A broken line 32 indicates the closed position (FIG. 3).

Control of valve 12 between its closed position and its open position is provided by an escapement mechanism 34. Escapement mechanism 34 restrains rotation of shaft 14 and thereby value 12 by engaging control member 36. Member 36 includes stops at each closed and open position of valve 12. It will be appreciated that there are preferably two closed positions and two open positions; therefore four stops are provided. However, a control member with one closed stop and one open stop will suffice. Member 36 is disposed on shaft 14 for rotation in unison therewith.

Figure 5:
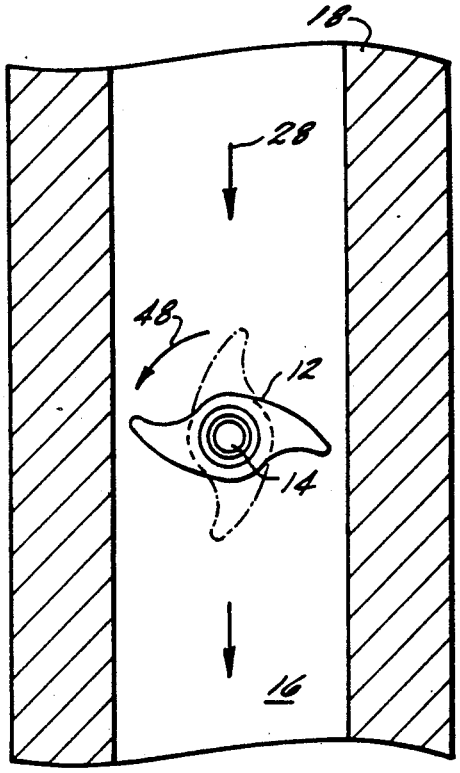
FIG. 5 is a side view partially sectioned illustrating the direction of rotation for the valve of FIG. 1.

Valve 12 is smaller than channel 16 so that the flow of drilling fluid is never completely restricted by valve 12 (i.e., in its closed position) as is clearly shown in FIG. 2 and indicated by arrows 38 representing drilling fluid flow around valve 12. Valve 12 comprises two opposing curved blades 40, 42 extending from a cylindrical member 43. Member 43 is disposed on shaft 14 and includes seals 44 to prevent drilling fluid flowing in channel 16 from entering recess 20 and opening 22. Each blade 40, 42 has a concave surface 45 opposed by a convex surface 46. These blades 40, 42 are configured to provide rotational torque, in a counter clockwise direction as is indicated by an arrow 48 (FIG. 5), in response to the flow of drilling fluid in channel 16.

A solenoid 46 actuates escapement mechanism 34 between the open and closed positions of valve 12. Solenoid 46 is powered by an electrical current presented over wire conductors (not shown). When solenoid 46 is actuated (i.e., the current is on), escapement 34 engages control member 36 at a stop indicative of the closed position. The stop is restrained in this position as long as solenoid 46 remains actuated. This restrains shaft 14 from rotation and positions valve 12 for maximum restriction of drilling fluid flow (FIG. 2). The restriction of fluid flow generates a pressure increase at valve 12 which permeates through the fluid up the drill string to the surface where the pulse is detected by well known methods (e.g., pressure pulse transducer). This pulse (or pressure wave) is known as a positive pressure pulse.

When solenoid 46 is deactuated (i.e., the current is off) escapement 34 releases the stop indicative of the closed position and valve 12 rotates in response to the flow of drilling fluid (as described hereinbefore). Valve 12 rotates until the next stop of control member 36 is engaged by escapement 34. This stop is indicative of the open position. The stop is restrained in this position until solenoid 46 is again actuated. This restrains shaft 14 from rotation, and positions valve 12 for minimum restriction of drilling fluid flow (FIG. 4), which relieves the pressure that was present at valve 12 when it was closed. Solenoid 46 is actuated in response to electrical signals. These signals can be encoded with information of downhole conditions.

When less restriction to drilling fluid flow is required, a partially closed position may be defined. This may be required with a high rate of drilling fluid flow and when a fully closed valve may cause an excessively large pressure pulse. This partially closed position would replace the closed positions of the preferred embodiment. Stops indicative of the partially closed positions would be located to restrain valve 12 at an acute angle relative to the direction of fluid flow. Otherwise, the operation of an open and partially closed rotating pulse valve is the same as described in the preferred embodiment.

Although solenoid 46 is described for actuating escapement 34, any device capable of actuating escapement 34 may be employed (e.g., a motor). Further, although valve 12 is described as rotating in a counter clockwise direction, blades 40 and 42 may be configured for rotation in a clockwise direction. While it is preferred than when solenoid 46 is energized, valve 12 is closed and when solenoid 46 is deenergized, valve 12 is open, the opposite sequence may also be employed.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for generating pressure pulses in a drilling fluid in a drill collar section of a drill string comprising:

rotating valve means substantially diametrically mounted in a drill string segment, said rotating valve means alternating between a first position corresponding to more resistance to the flow of drilling fluid and a second position corresponding to less resistance to the flow of drilling fluid, said rotating valve means being impelled by the flow of drilling fluid; and restraining means disposed in the drill collar segment, said restraining means restraining said rotating valve means in said first position and releasing said rotating valve means from said first position in response to control signals indicative of a downhole condition.

2. The apparatus of claim 1 wherein:

said restraining means further provides means for restraining said rotating valve means in said second position and for releasing said rotating valve means from said second position in response to said control signals indicative of the downhole condition.

3. The apparatus of claim 1 further comprising:

actuator means being disposed in said drill collar segment, said actuator means alternatively actuating said restraining means between restraining said rotating valve means in said first position and releasing said rotating valve means from said first position.

4. The apparatus of claim 2 further comprising:

actuator means being disposed in said drill collar segment, said actuator means alternatively actuating said restraining means between said first and second positions in response to control signals indicative of a downhole condition.

5. The apparatus of claim 1 wherein:

said restraining means comprises an escapement mechanism.

6. The apparatus of claim 4 wherein said rotating valve means comprises:

a shaft extending across an annular opening of the drill string segment wherein drilling fluid flows;

a valve having a pair of opposing blades disposed on said shaft for rotation in unison with said shaft, said blades impelling said valve in response to the flow of drilling fluid, wherein said blades are substantially normal to the direction of the flow of drilling fluid in said first position and said blades are substantially in alignment with the direction of the flow of drilling fluid in said second position.

7. The apparatus of claim 6 wherein:

a portion of said shaft extends into a hatch in said drill collar segment; and a control member having a first stop corresponding to said first position and a second stop corresponding to said second position, said control member being disposed on said portion of said shaft extending into said hatch, said first and second stops being engaged by said restraining means.

8. The apparatus of claim 6 wherein said blades each include a concave surface opposed by a convex surface.

9. The apparatus of claim 3 wherein said actuator means comprises a solenoid.

10. The apparatus of claim 3 wherein said actuator means comprises a motor.

11. The apparatus of claim 1 wherein said first position corresponds to a maximum resistance to the flow of drilling fluid.

12. The apparatus of claim 11 wherein said second position corresponds to a minimum resistance to the flow of drilling fluid.

13. The apparatus of claim 4 wherein said rotating valve means comprises:

a shaft extending across an annular opening of the drill string segment wherein drilling fluid flows;

a valve having a pair of opposing blades is disposed on said shaft for rotation in unison with said shaft, said blades impelling said valve in response to the flow of drilling fluid, wherein said blades are at an acute angle to the direction of the flow of drilling fluid in said first position and said blades are substantially in alignment with the direction of the flow of drilling fluid in said second position.

14. The apparatus of claim 13 wherein:

a portion of said shaft extends into a hatch in the drill collar segment; and a control member having a first stop corresponding to said first position and a second stop corresponding to said second position, said control member being disposed on said portion of said shaft extending into said hatch, said first and second stops being engaged by said restraining means.

15. An apparatus for generating pressure pulses in a drilling fluid in a drill string comprising:

rotating valve means substantially diametrically mounted in a drill string segment, said rotating valve means being movable between a first position corresponding to more resistance to the flow of drilling fluid and a second position corresponding to less resistance to the flow of drilling fluid, said rotating valve means being impelled by the flow of drilling fluid, escapement means disposed in the drill string segment, said escapement means restraining said rotating valve means in said first position and releasing said rotating valve means from said first position, said escapement means restraining said rotating valve means in said second position and releasing said rotating valve means from said second position; and actuator means being disposed in said drill collar segment, said actuator means alternatively actuating said escapement means between said first and second positions in response to control signals indicative of a downhole condition.

16. The apparatus of claim 15 wherein said rotating valve means comprises:

a shaft extending across an annular opening of the drill string segment wherein drilling fluid flows;

a valve having a pair of opposing blades disposed on said shaft for rotating in unison with said shaft, said blades impelling said valve in response to the flow of drilling fluid, wherein said blades are substantially normal to the direction of the flow of drilling fluid in said first position and said blades are substantially in alignment with the direction of the flow of drilling fluid in said second position.

17. The apparatus of claim 16 wherein:

a portion of said shaft extends into a hatch in said drill collar segment; and a control member having a first stop corresponding to said first position and a second stop corresponding to said second position, said control member being disposed on said portion of said shaft extending into said hatch, said first and second stops being engaged by said escapement means.

18. The apparatus of claim 16 wherein said blades each include a concave surface opposed by a convex surface.

19. The apparatus of claim 15 wherein said actuator means comprises a solenoid.

20. The apparatus of claim 15 wherein said actuator means comprises a motor.

21. The apparatus of claim 15 wherein said first position corresponds to a maximum resistance to the flow of drilling fluid.

22. The apparatus of claim 21 wherein said second position corresponds to a minimum resistance to the flow of drilling fluid.

23. The apparatus of claim 15 wherein said rotating valve means comprises:

a shaft extending across an annular opening of the drill string segment wherein drilling fluid flows;

a valve having a pair of opposing blades is disposed on said shaft for rotation in unison with said shaft, said blades impelling said valve in response to the flow of drilling fluid, wherein said blades are at an acute angle to the direction of the flow of drilling fluid in said first position and said blades are substantially in alignment with the direction of the flow of drilling fluid in said second position.

24. The apparatus of claim 23 wherein:

a portion of said shaft extends into a hatch in the drill collar segment; and a control member having a first stop corresponding to said first position and a second stop corresponding to said second position, said control member being disposed on said portion of said shaft extending into said hatch, said first and second stops being engaged by said escapement means.

* * * * *